US006435778B1

(12) United States Patent
Fox

(10) Patent No.: US 6,435,778 B1
(45) Date of Patent: Aug. 20, 2002

(54) CABLE TRUSS SYSTEM AND RELATED METHOD OF INSTALLATION

(75) Inventor: William G. Fox, White Plains, KY (US)

(73) Assignee: Triad Support Systems, Inc., White Plains, KY (US)

( * ) Notice: Subject to any disclaimer, the term of this patent is extended or adjusted under 35 U.S.C. 154(b) by 0 days.

(21) Appl. No.: 09/524,487

(22) Filed: Mar. 13, 2000

(51) Int. Cl.[7] ..... E21D 20/00; E21D 21/00

(52) U.S. Cl. ..... 405/302.2; 405/259.1; 405/259.6

(58) Field of Search ..... 405/258.1, 259.1, 405/259.4, 259.5, 259.6, 288, 302.2

(56) References Cited

U.S. PATENT DOCUMENTS

| | | | | | |
|---|---|---|---|---|---|
| 3,107,902 | A | | 10/1963 | Calder | 299/11 |
| 3,427,811 | A | | 2/1969 | White | 405/259.3 |
| 3,509,726 | A | * | 5/1970 | White | 405/302.2 |
| 3,601,994 | A | | 8/1971 | Galis | 405/288 |
| 3,650,112 | A | | 3/1972 | Howlett et al. | 405/259.5 |
| 4,265,571 | A | | 5/1981 | Scott | 405/259.3 |
| 4,395,161 | A | | 7/1983 | Wilson et al. | 405/302.1 |
| 4,456,405 | A | | 6/1984 | Galis | 405/288 |
| 4,498,816 | A | | 2/1985 | Korpela et al. | 405/259.1 |
| 4,601,616 | A | | 7/1986 | Barish et al. | 405/288 |
| 4,634,318 | A | | 1/1987 | Koumal | 405/302.2 |
| 4,679,967 | A | * | 7/1987 | Hipkins, Sr. et al. | 405/288 |
| 4,775,266 | A | | 10/1988 | Seegmiller | 405/288 |
| 4,776,729 | A | | 10/1988 | Seegmiller | 405/288 |
| 4,934,873 | A | | 6/1990 | Calandra, Jr. | 405/288 |
| 4,946,315 | A | | 8/1990 | Chugh | 405/288 |
| 5,018,907 | A | | 5/1991 | Chugh et al. | 405/302.1 |
| 5,259,703 | A | | 11/1993 | Gillespie | 405/259.6 |
| 5,288,176 | A | | 2/1994 | Huff et al. | 405/259.6 |
| 5,415,498 | A | | 5/1995 | Seegmiller | 405/288 |
| 5,466,095 | A | | 11/1995 | Scott | 405/302.2 |
| 5,525,013 | A | | 6/1996 | Seegmiller et al. | 405/259.3 |
| 5,584,608 | A | | 12/1996 | Gillespie | 405/259.6 |
| 5,624,212 | A | | 4/1997 | Gillespie | 405/302.2 |
| 5,755,535 | A | | 5/1998 | Fox | 405/288 |
| 5,829,922 | A | | 11/1998 | Calandra, Jr. et al. | 405/302.2 |
| 5,836,720 | A | * | 11/1998 | Stankus et al. | 405/302.2 |
| RE36,019 | E | | 12/1998 | Stankus | 405/259.6 |
| 5,913,641 | A | | 6/1999 | Long | 405/302.2 |
| 5,919,006 | A | | 7/1999 | Calandra, Jr. et al. | 405/302.2 |
| 5,931,064 | A | | 8/1999 | Gillespie | 81/120 |
| 5,951,208 | A | | 9/1999 | Wilson et al. | 405/259.6 |
| 5,967,703 | A | * | 10/1999 | Stankus et al. | 405/302.2 |

OTHER PUBLICATIONS

Double Bolt Truss, F.M. Locotos Co., Inc. Pittsburgh, PA No Date.

Current Trends in Roof Truss Hardware, Mangelsdorf, C.P. Second Conference on Ground Control Mining, Jul. 19–21, 1982. West Virginia University.

Hydraulic Tensioning of a Birmingham Roof Truss, Bollier, C.W. Second Conference on Ground Control in Mining, Jul. 19–21, 1982. University of Pittsburgh, Pittsburgh, PA.

* cited by examiner

*Primary Examiner*—Thomas B. Will
*Assistant Examiner*—Tara L. Mayo
(74) *Attorney, Agent, or Firm*—King & Schickli, PLLC

(57) ABSTRACT

A truss system for supporting a face of a passage in a geological structure, such as a mine roof. A truss support bracket is carried on the proximal end of an anchor positioned adjacent each of a pair of spaced boreholes formed in the face or mine roof. At least one of the brackets includes a retainer, such as a split wedge retainer, for receiving a corresponding end of a truss member, such as an elongated cable, spanning across the adjacent face. A rotary fastener threaded to the proximal end of each anchor holds each bracket in place. Using a motive device, such as the rotational socket on a bolting machine, a selected one of the fasteners is rotated such that the corresponding bracket is drawn along the anchor and at least partially into the borehole to tension the truss member. To provide the desired support, one or more plates are carried on the truss member engage the face once tensioning is complete. In the preferred embodiment, at least one of the brackets is cylindrical and is drawn completely into the corresponding borehole during tensioning. A related method of installing a truss member on the face of a passage is also disclosed.

27 Claims, 4 Drawing Sheets

32
12a, 14a
30
24
26
28
16,18
23
L
20,22
C
B
GS
12b
12
13
R
12a
16
20
L

CABLE TRUSS SYSTEM AND RELATED METHOD OF INSTALLATION

TECHNICAL FIELD

The present invention relates generally to supporting the face of a passage in a geological structure, and more particularly, to a truss system for supporting a mine roof and a related installation method.

BACKGROUND OF THE INVENTION

In recent decades, a number of proposals for supporting the face of a passage in a geological structure, such as the roof in an underground mine, have been made. The typical arrangement employs anchors, such as roof bolts, that extend into spaced bores drilled in the face at opposed angles. A support bracket secured to each angled anchor external to the corresponding bore provides support for a horizontally extending truss member. Depending on the particular application, the truss member may be a cable or metal rod, the ends of which are initially secured to the corresponding bracket by hand. Once secured in place such that it spans between the brackets, the truss member is tensioned to compress and provide support for the adjacent face. Typically, tensioning is either completed manually or by using hand-held power tools.

As explained in my prior U.S. Pat. No. 5,755,535, the major shortcomings of prior art systems include: (1) the relatively large number of diverse parts required to form the truss system, which increases the manufacturing cost; and (2) the difficulty in providing the proper tensioning for the truss member to create the desired level of support. Also, most systems require the installer to determine the length of the truss member with some precision prior to installation to ensure full tensioning. Of course, this increases the overall time required for installation, which is often regarded as a critical factor in determining whether a particular truss system is commercially viable.

To overcome these shortcomings, the '535 patent discloses an improved truss system and related installation method that represents in some respects a radical departure from the approach taken in the prior art. This system reduces the number and diversity of parts required by using identical brackets that not only connect with both the anchor and the truss member, but also serve to support the face adjacent to each borehole when the truss member is properly tensioned. During installation, a drive adaptor allows a rotational socket on a drill head of a bolting machine to provide the necessary torque required for tensioning the horizontal truss member (either a cable or metal rod). This fully eliminates the problems associated with manual tensioning or the use of hand-held power tools. Since a lifting mechanism is available to raise the rotational socket/drill head into the desired position, this also reduces the amount of effort required by the installer, as well as the concomitant incidence of fatigue, especially for installations on mine roofs. Finally, instead of a rotary fastener, a split-wedge retainer holds one end of the truss member securely in a frusto-conical passageway formed in the bracket. Since the corresponding end of the truss member need not be threaded, this eliminates the need for precisely determining the length of the truss member required prior to installation to ensure that full tensioning is reliably accomplished. Overall, the result is a simplified, but exceedingly reliable truss system and installation method.

Despite this significant advance set forth in this earlier '535 patent, I have discovered that there exists an opportunity to provide a highly reliable truss system that is even less costly to manufacture, as well as even simpler and less time consuming to install. Of course, one of the major areas for lowering the manufacturing cost and installation time is to reduce even further the overall number, diversity and complexity of the parts required. This includes eliminating the need for specialized adaptors to transmit driving torque from the bolting machine during tensioning. Moreover, the system would still remove not only the need for threading one or both ends of the truss member, but also the need for precisely determining the length of the truss member required prior to installation to ensure proper tensioning. Overall, the resulting truss system would provide full strength support for the face at a lower manufacturing cost and with less installation effort required.

SUMMARY OF THE INVENTION

Keeping the above needs in focus, it is a primary object of the present invention to provide a truss system for supporting the face of a passage in a geological structure that further overcomes the shortcomings and limitations of the prior art systems.

Another object of the present invention is to provide a truss system including spaced borehole anchors carrying truss support brackets positioned in the borehole and at least one truss member that spans between the brackets, wherein the truss member is set up and tensioned by moving either or both of the brackets along its corresponding anchor.

Still another related object of the present invention is to provide a tension-activated truss system wherein the force for moving the truss support brackets along the corresponding anchor and into the borehole is provided by a bolting machine, whereby the need for manual force or hand-held power tools to provide the necessary tensioning action is eliminated.

A further object of the present invention is to provide a truss support bracket that is drawn along an anchor adjacent its borehole and into the corresponding borehole during tensioning, while a separate face support or plate carried by the truss member engages and supports the adjacent face of the passage.

Yet another object of the present invention is to provide a preferred truss system wherein at least one of the truss support brackets is capable of taking up any slack in the truss member prior to tensioning, even when in position in the borehole, thereby eliminating the need for precisely determining the length of the truss member required prior to installation.

A related, but more specific, object of the present invention is to provide a truss support bracket that carries a split wedge retainer for receiving and capturing an end portion of the truss member, whereby the need for threading the corresponding end of the truss member for receiving a rotary fastener or the like is eliminated.

Still a further object of the present invention is to provide a related method of installing a truss system wherein only a selected one of the truss support brackets needs to move along the corresponding anchor into the borehole after initial set up of the system in order to tension the truss member.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved truss system and related installation method are provided for supporting a face of a passage in a geological structure, such as a mine roof. In its broadest aspects, the truss system of the present invention includes first and second anchors that are positioned in spaced boreholes formed in the selected face of the passageway. A truss support bracket is positioned adjacent its borehole on each anchor and held in position by a fastener. At least one truss member, such as an elongate cable, spans between the brackets, and a motive device is provided for engaging a selected one of the fasteners to move the associated bracket further along the anchor and deeper into the corresponding borehole. As should be appreciated, as the bracket moves deeper into the borehole, the truss member is tensioned to compress and provide support for the adjacent face of the passage.

In the preferred embodiment, the selected fastener for holding the bracket in place and moving it into the corresponding borehole is a rotary fastener threaded to the proximal end of the corresponding anchor. The motive device for engaging this fastener is a rotational socket of the type provided on the drill head of a standard bolting machine, which is of course typically employed to drill boreholes and install face anchors, such as roof bolts. The preferred form of rotary fastener is an elongated nut, but of course other equivalent types of connectors or fasteners may be employed for holding the corresponding bracket in place and moving it along the anchor during tensioning.

As should be appreciated, once the anchors are positioned in the boreholes, the selected fastener holding the bracket in place is positioned adjacent the face, but just inside the borehole. To transmit torque from the rotational socket to this selected fastener when positioned in the borehole opening, an extension tool, such as an elongate wrench having a deep well socket head, is used. This elongated tool ensures that the desired engagement with the fastener is maintained at all times as it is drawn along the corresponding anchor further into the borehole, and eliminates the need for the multiple repositioning of the rotational socket during installation.

By using the rotational socket on a bolting machine to provide the desired tensioning, the need for employing manual tools or heavy, awkward hand-held power tools is eliminated. Moreover, the amount of tension supplied may be precisely controlled, since the rotational socket on the standard bolting machine is limited by a built-in torque control feature. The use of a bolting machine is also particularly advantageous when the truss installation is coupled to a mine roof since: (1) the lifting mechanism may be used to raise the rotational socket into position for installing the anchors, as is known in the art, as well as to move the wrench or other extension tool into the hole such that the fastener remains fully engaged during tensioning; and (2) pivotal mounting of the drill head allows the drill head to tilt in a horizontal plane such that the socket/extension tool may be aligned with the fastener in the angled borehole. Of course, this potentially infinite adjustability of the rotational socket/drill head makes the overall tensioning operation simplified and easier for the installer(s).

In one particularly preferred embodiment, each bracket is identical and includes a first passageway for receiving the proximal end of the corresponding anchor and a second passageway for receiving an end of the truss member. The second passageway is tapered or frusto-conical and carries a retainer, such as a split wedge retainer, that captures the corresponding end of the truss member during installation. As should be appreciated, the use of a split-wedge retainer is advantageous for several reasons. First, it eliminates the need for threading the end of the truss member and providing the associated rotary fastener required in many prior art systems that is easily lost or misplaced during installation. Secondly, it allows the installer to feed the end of the truss member blindly through the bracket into the borehole as necessary to reduce the amount of slack prior to tensioning. Advantageously, the wedge halves automatically separate in unison upon engagement to allow the end of the truss member to pass. To prevent the bracket from moving along the anchor during this operation, a first stop is carried on each anchor adjacent to the bracket. However, this stop does not prevent the bracket from moving into the borehole when the selected fastener is engaged. Also, the second passageway in each bracket includes a second stop to capture the retainer therein and prevent it from backing or lifting out of the bracket as the end of the truss member is inserted.

During the preferred installation, a first bracket is placed adjacent its borehole and drawn up on its anchor. A first end of the selected truss member is installed in the corresponding bracket by passing it through the corresponding split wedge retainer. The portion of the truss member extending out of the borehole is then manually tugged such that the split wedge retainer is snugged into place in the frusto-conical passageway. In this position, the retainer is seated in this passageway such that it grips the truss member and securely holds it in place. Then, the opposite bracket is placed adjacent its borehole and drawn up, whereupon the corresponding end of the truss member is blindly inserted into the corresponding passageway of the bracket. This opposite end is fed through the passageway until substantially all of the sag is eliminated, and then the portion of the trust member extending out of the borehole is manually tugged to seat the corresponding split wedge retainer in the passageway. Preferably, the truss member is then tensioned by engaging only a selected one of the fasteners to move the corresponding bracket further into the borehole. If necessary, both fasteners may be engaged for tensioning the truss system, depending on mining conditions, practices and equipment.

As should be appreciated, since each end of the truss member may be passed completely through the corresponding retainer in each bracket and into the borehole, the present system allows for the installer to roughly approximate the length of the truss member required for a particular installation. This of course advantageously eliminates the need for precisely calculating the length of the truss member required prior to installation. Any slack is taken up by simply forcing the one or both ends of the truss member further into the borehole until it spans between the brackets adjacent to the face. This flexibility eases the installation process, which serves to reduce the overall cost. Also, it facilitates installation where the approximate spacing of the boreholes is known, but the face of the adjacent passageway is graded or uneven.

At least one, and most preferably a pair of supports in the form of plates are carried on the truss member. These support plates serve to engage the face adjacent to the boreholes when the truss member is fully tensioned. Each plate preferably includes an eyelet through which the corresponding end of the truss member is inserted just before it is passed into the associated bracket. Preferably, during the installation of the truss system of the present invention, stops are placed on the truss member to ensure that the supports are held adjacent to the borehole at all times. This allows the operator to focus on the installation of the truss member and not worry about the positioning of the support plates until the system is ready for final tensioning.

To install the truss system of the present invention, and in accordance with the related method described herein, the anchors are positioned in first and second spaced boreholes drilled in the face of the passage. In a most preferred embodiment of the installation method, the boreholes are drilled such that each includes "stepped" bores having different diameters. The first bore is oversized for receiving the bracket, while the second bore is sized for receiving the resin cartridge or expansion unit that serves to hold the anchor in position. As should be appreciated by those skilled in the art, the specific diameters and lengths of these stepped bores depend on the particular application or mine conditions encountered.

To secure the anchor in the borehole, any conventional means may be employed. As known in the art, a cartridge containing resin or grouting may be inserted in the borehole prior to insertion of the anchor, or an expansion unit may be deployed to secure the anchor to the rock or other material in which the borehole is formed. Additionally, a combination of the two technologies may be employed, as shown in my prior '535 patent, the disclosure of which is incorporated herein by reference.

One of the truss support brackets is then positioned on each anchor adjacent its corresponding borehole as described above, and a truss member, such as an elongated cable, is attached to each corresponding bracket, preferably also in the manner described above, such that it spans across the adjacent face. Then, by moving a selected one of the brackets along the anchor further into the corresponding borehole, such as by engaging the corresponding rotary fastener with the rotational socket of a bolting machine, the truss member is automatically and fully tensioned.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention and, together with the description serve, to explain the principles of the invention. In the drawings.

Reference will now be made in detail to the present preferred embodiment of the invention, an example of which is illustrated in the accompanying drawing.

DETAILED DESCRIPTION OF THE INVENTION

Figure 1A:
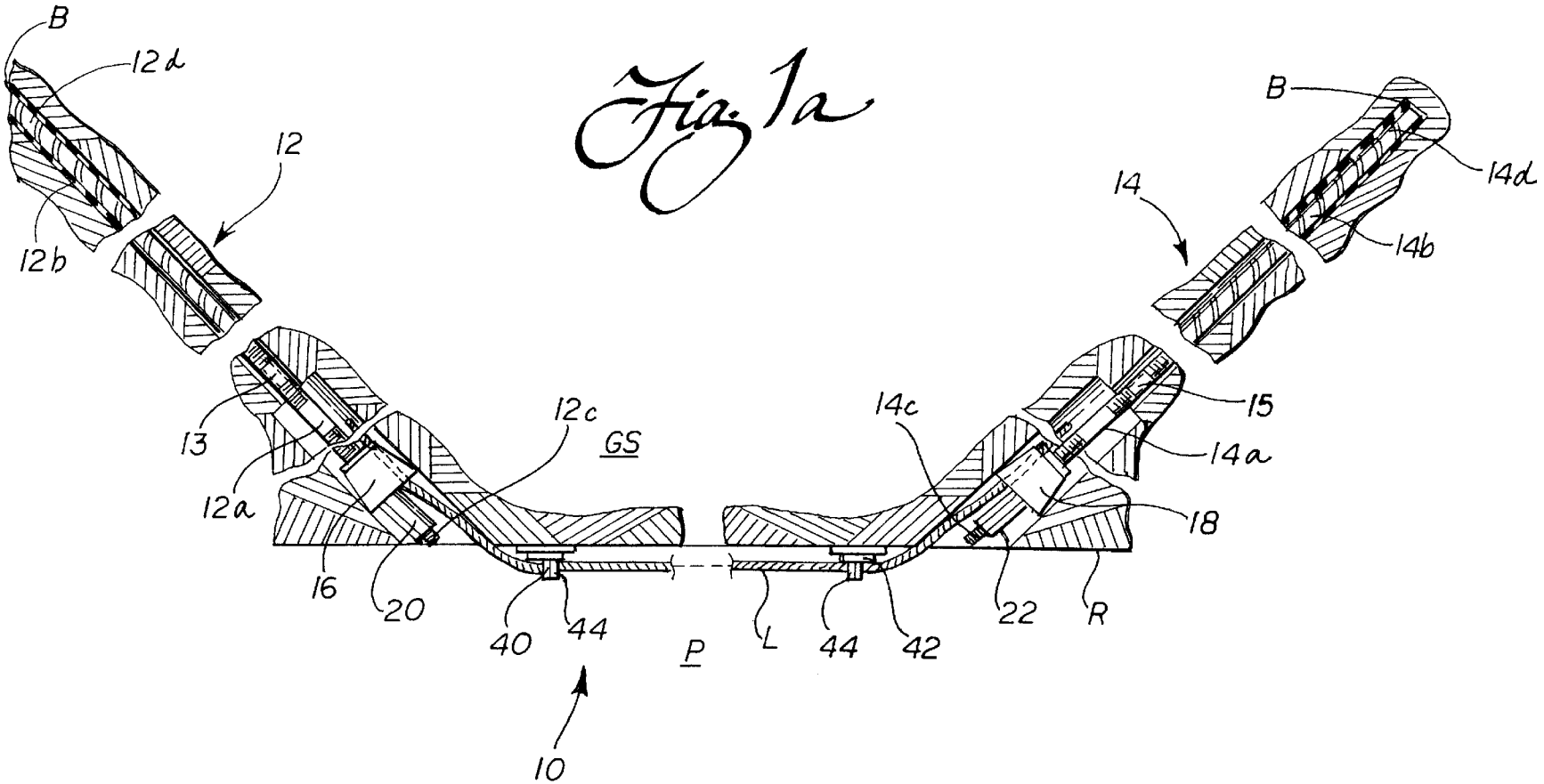
FIG. 1*a* is an enlarged, partially cutaway front view of the fully tensioned truss system of the present invention installed in a mine roof.
Figures 1B, 2:
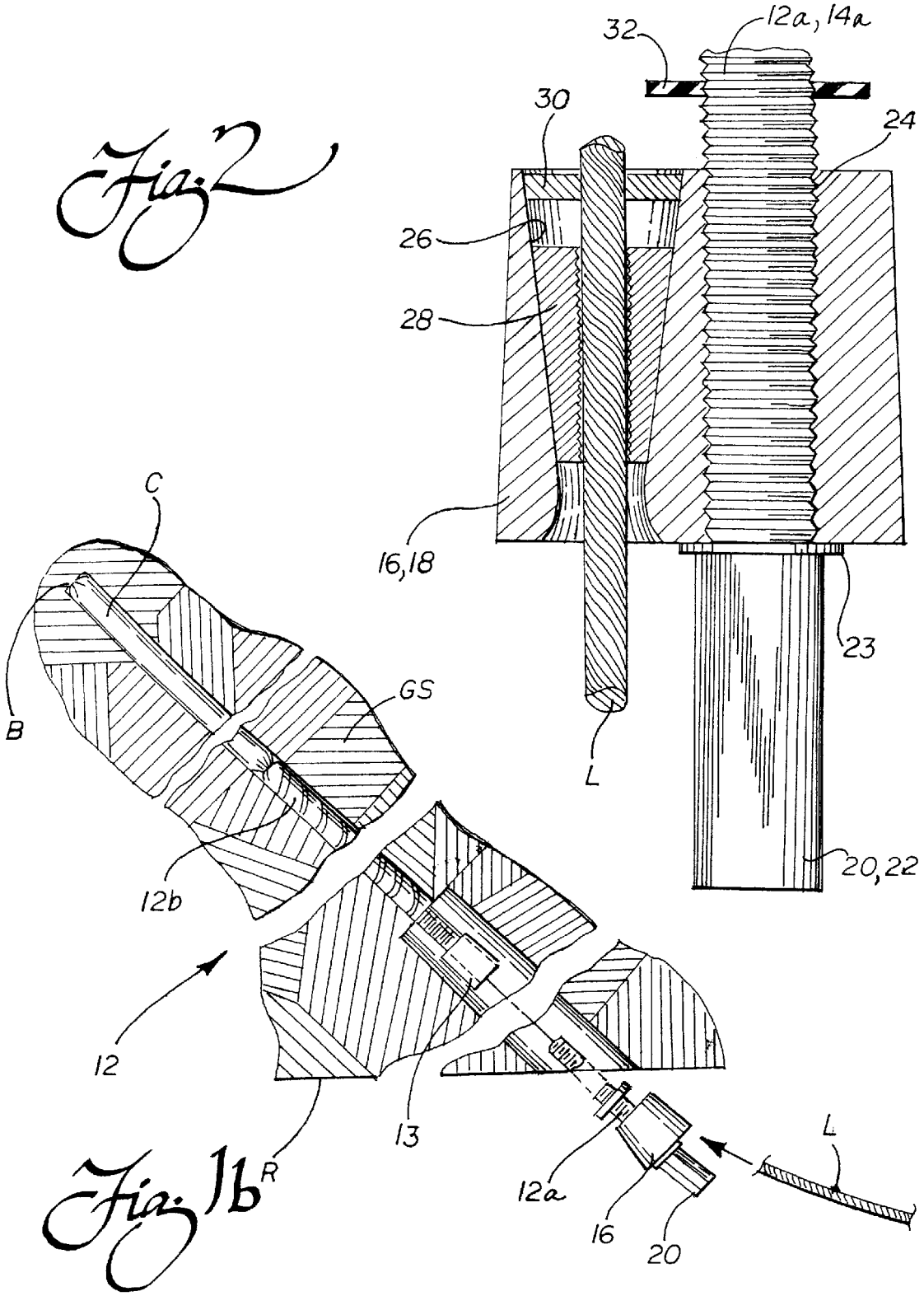
FIG. 1*b* is an enlarged, partially exploded, partially cutaway front view of one side of the truss system of the present invention with its bracket adjacent the corresponding borehole and prior to complete installation in the borehole.
FIG. 2 is an enlarged, partially cross-sectional, partially cutaway side view of the truss support bracket of the most preferred embodiment of the present invention, illustrating in particular the split wedge retainer captured in a tapered or frusto-conical passageway that allows for the blind insertion of the truss member when the bracket is adjacent to and/or in the borehole.

Reference is now made to FIG. 1*a*, which shows a fully installed and tensioned truss system 10 of the present invention, and FIG. 1*b*, which particularly focuses on the installation in one of a pair of spaced boreholes B formed in the face of a passage P within a geological structure GS, such as a mine. Typically, the structure GS comprises an overburden of rock, such as sandstone and/or limestone. In a mine, the passage P is a tunnel-like area in which coal or another natural resource has been removed. While the truss system 10 and related installation method of the present invention is described as being used to reinforce and sustain a mine roof R, it should be understood that the present invention may be applied to support any one of the other faces of the passage P.

As shown in FIG. 1*a*, the truss system 10 includes first and second anchors, which in the preferred embodiment are in the form of roof bolts 12, 14. The bolts 12, 14 extend into angled boreholes B previously drilled in the corresponding face of the geological structure GS, such as the mine roof R as shown in FIG. 1*a*, using a drill bit mounted in a drill head on a bolting machine, as described in my prior '535 patent. For purposes of illustration only, the boreholes B are shown as extending at a 45° angle slanting inwardly with respect to the passage P. As is well known in the art, bolts 12, 14 are commonly used in conjunction with other hardware and apart from a truss system of the type shown to reinforce a mine roof.

With reference to FIG. 1*b*, a more detailed view of the first anchor or roof bolt 12 is shown. In the most preferred embodiment, the bolt 12 is segmented, and thus as illustrated in FIG. 1*b*, includes a proximal segment 12*a* and a distal segment 12*b* held together by a coupler 13. Preferably, at least a portion of the corresponding ends of the segments 12*a*, 12*b* are threaded, as is the coupler 13. A specific description of a similar type of segmented anchor bolt is found in U.S. Pat. No. 4,679,967 to Hipkins, Sr. et al. (assigned to the F. M. Locotos Co., Inc. of Pittsburgh, Penn.), the disclosure of which is incorporated herein by reference. Instead of segmented anchors or bolts, unitary roof bolts or other anchors of a type known in the art may be employed, such as those shown or described in my prior '535 patent and others. The opposite bolt 14 is similarly constructed and includes proximal segment 14*a*, distal segment 14*b*, and coupler 15 (see FIG. 1*a*).

To anchor each bolt 12, 14 in the corresponding borehole B in this preferred embodiment, a cartridge C containing an epoxy resin is first inserted ahead of the distal segment 12*b* or 14*b*. As is known in the art and outlined further in the description that follows, the resin cartridge C is ruptured by the bolts 12 or 14 during installation, such that the epoxy resin held therein mixes with a catalyst and hardens in a rapid fashion. Alternatively, or in conjunction with resin grouting, self-deploying expansion units or other types of bolt anchors of a type known in the art may also be employed to ensure that each bolt 12, 14 is fully secured in place.

Referring back to FIG. 1*a*, each first and second bolt 12, 14 carries a corresponding first and second truss support bracket 16, 18. The brackets 16, 18 are retained on proximal ends 12*c*, 14*c* of the corresponding bolts 12, 14 by fasteners which in the preferred embodiment are in the form of elongated nuts 20, 22. Each nut 20, 22 has a square or hexagonal shape for engaging a corresponding rotational socket on the bolting machine or other motive device, such as through a wrench as described further below. These nuts 20, 22, termed "bow nuts" in the art, are internally threaded to correspond with the proximal ends 12*c*, 14*c* of the bolts 12, 14. To reduce frictional wear and facilitate the relative rotational movement created during installation and tensioning, a washer 23 or other type of spacer may also be provided at the interface between the brackets 16, 18 and the nuts 20, 22 (see FIGS. 2 and 3*d*).

With reference now to FIG. 2, an enlarged view of one of the brackets 16 or 18 is shown. In this most preferred embodiment, each bracket 16, 18 is identical and is formed of a substantially cylindrical cast metal sleeve or body having an outer surface that is slightly tapered when viewed in a vertical plane. This shape facilitates entry into an oversized portion of the borehole B (discussed below) during installation. Also, since the brackets 16, 18 are identical in this embodiment, they are interchangeable, which further simplifies the installation process.

Each bracket 16, 18 includes a first non-threaded passageway 24 for receiving the proximal segment 12*a*, 14*a* or proximal end 12*c*, 14*c* of the corresponding bolt 12, 14. An adjacent, second passageway 26 is provided for receiving a truss member, which is shown for purposes of illustration as a multi-strand, high strength cable L. In the preferred embodiment, this second passageway 26 is substantially parallel to the first passageway 24 and is tapered or frusto-conical in shape for carrying a similarly shaped split-wedge retainer 28, which as explained further below serves to grip and hold the truss member, or cable L, when snugged in place.

The split wedge retainer 28 comprises first and second opposed halves each having inwardly projecting gripping teeth or serrations. The retainer 28 is captured in the tapered passageway 26 by a stop, such as a washer 30 inserted therein to create a press or interference fit. Alternatively, the stop may take the form of a retainer ring (not shown) held within a circumferential groove (not shown) formed in an upper end of the passageway 26. As outlined further in the description that follows, this stop, or press fit washer 30, prevents the split wedge retainer 28 from backing or lifting out of the tapered passageway 26 as the cable L is blindly inserted during installation.

Also, to prevent the brackets 16, 18 themselves from moving along the corresponding bolt 12,14 during insertion of the truss member, a second stop, such as a resilient ring 32, is also provided on each anchor. As will be further appreciated after reviewing the description that follows, these resilient rings 32 sufficiently grip the threaded portion of the proximal segment 12*a* or 14*a* to prevent the bracket 16 or 18 from backing into the corresponding borehole B during installation of the cable L. However, the gripping force is easily overcome such that the rings 32 simply move along the bolt 12 or 14 when the selected bracket 16 or 18 is driven further into the borehole B during tensioning.

Figure 3A:
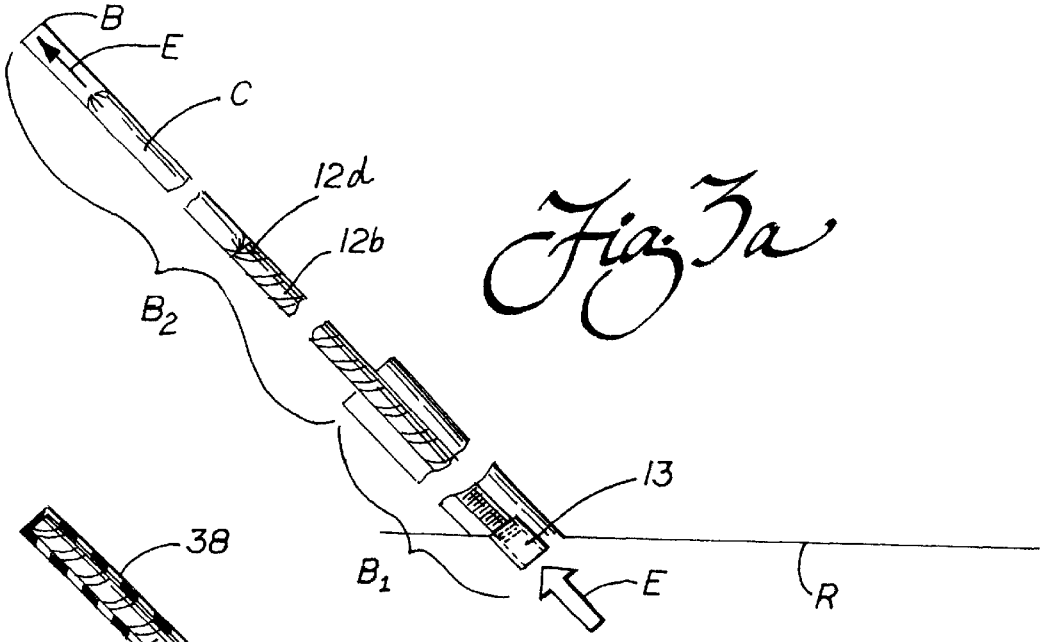
FIGS. 3*a*–3*e* are progressive schematic views showing the installation of the truss system of the present invention in one of the spaced boreholes, with the installation in the opposite borehole being substantially a mirror image thereof.

Referring now to the progressive views of FIGS. 3*a* to 3*e*, the method for installing and tension activating the truss system 10 of the present invention will now be described in detail. In FIG. 3*a*, spaced boreholes B have already been drilled at an angle into the overburden forming the mine roof R, such as by using a conventional drill bit mounted in the drill head DH on a bolting machine (not shown), such as described in my prior '535 patent. Preferably, each borehole B is drilled having an oversized first portion $B_1$ to accommodate the truss support brackets 16, 18. The remainder of each borehole B, or the second portion $B_2$, is then drilled in a conventional manner to a sufficient depth for receiving a distal end 12*d*, 14*d* or segment 12*b* or 14*b* of the anchor or roof bolt 12 or 14. In practice, it has been found that the length of the first, oversized portion $B_1$ should be approximately 24 inches. However, adjustments can be made as necessary for a particular bracket size, borehole spacing or anchor/bolt length. In any case, to ensure optimum results, the total length of each borehole B should be approximately two inches less than the total length of the corresponding anchor or bolt used, such that when properly installed the proximal end of each projects just outside of the borehole opening and is fully accessible.

Once the boreholes B are drilled in the manner described above, a resin cartridge C is inserted therein and manually pushed towards the back of the hole by the distal segment 12*b* of the anchor or roof bolt 12, which also carries the coupler 13 coupled thereto (see aligned action arrows labeled E in FIG. 3*a*). The bracket 16 is pre-fitted over the proximal segment 12*a* of the bolt 12, and the corresponding "bow" nut 20 is pre-installed onto it. The nut 20 is placed in a socket wrench 36 extended from the drill head DH of the bolting machine (see FIG. 3*e*). A pivoting linkage arm PA forms a part of the lifter mechanism on a standard bolting machine; however, of course, instead of a pivoting linkage arm, lifting action may be provided by a direct hydraulic cylinder connection to the drill head DH. Initially, while holding the distal segment 12*b*/coupler 13 in one hand, the installer guides the exposed threaded portion of the proximal segment 12*a* into the coupler 13 and rotates the two to create the threaded engagement. The rotational socket wrench 36 on the bolting machine is then used to complete the threaded union between the coupler 13 and the bolt segment 12*a*.

Figure 3B:
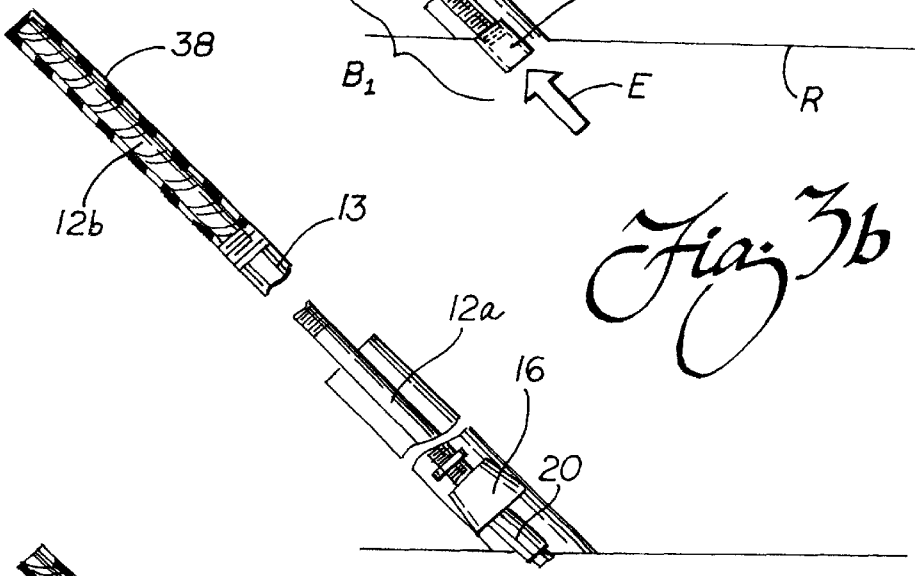
Figure 3E:
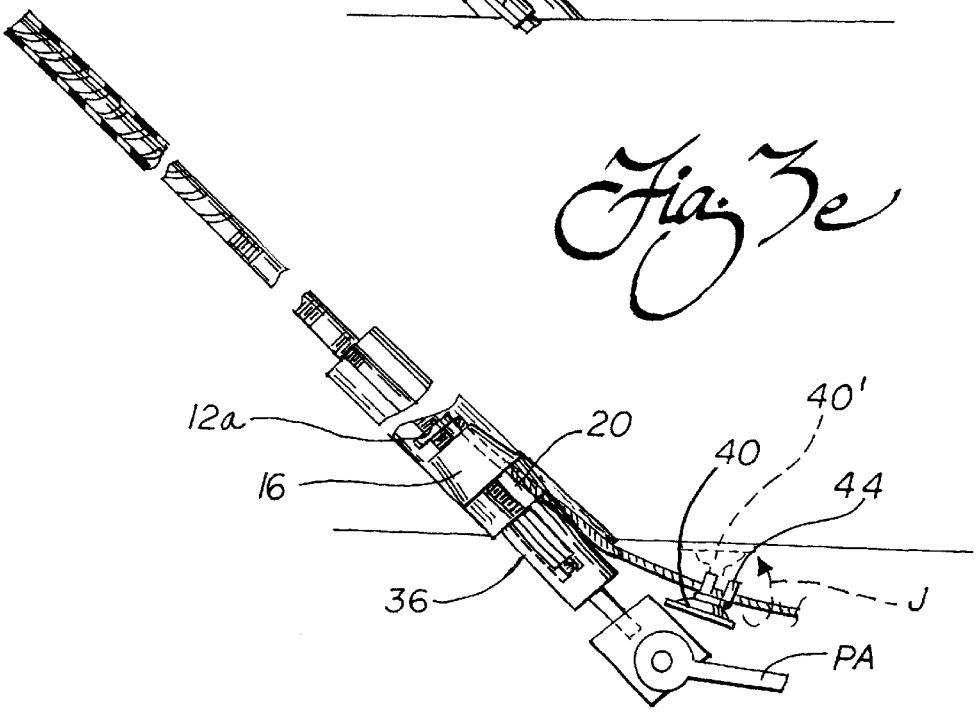

The socket wrench 36 has a deep well socket head (see FIG. 3*e*). The drill head DH/lifting mechanism PA of the bolting machine together are used to force the assembled anchor or bolt 12 to the rear of the borehole B such that the resin cartridge C ruptures. The drill head DH spins the bolt 12 for 3–5 seconds to mix the epoxy resin with the catalyst, and then the bolt 12 is held in place in the borehole B for another 3–5 seconds to allow the resin to fully cure. The deep well socket wrench 36 is then removed from the nut 20. As should be appreciated, the fully installed bolt 12 is held in place in the borehole B by an envelope of hardened epoxy resin 38, as is shown in FIG. 3*b*. This installation procedure is then repeated for the opposite borehole B in a substantially identical manner. As should be appreciated from viewing FIG. 3*b*, once installed the brackets 16 or 18 are adjacent, and indeed usually about 3–4 inches up in the borehole B, which advantageously prevents them from creating any lateral pressure on the adjacent borehole opening during tensioning (see below).

Next, the truss member, or multi-strand high strength cable L in the most preferred embodiment, is installed such that is spans between the brackets 16, 18. Advantageously, because any slack in the cable L is accommodated by the brackets 16, 18 of the present invention, the length selected can simply approximate the distance between the spaced boreholes B, plus an additional 3–4 feet. Of course, the amount added may vary depending on the particular installation, but the point remains that calculating the length of the cable with any precision is unnecessary, which advantageously reduces the time required for installation.

Prior to inserting the cable L in the corresponding passageway 26 of the bracket 16, a first end of it is passed through an eyelet in a first support plate 40. A ring-shaped stop 44 is positioned on the cable L. Preferably, the stop 44 is resiliently clamped to the cable L to allow it to be relocated along the cable L. This stop 44 serves to retain the support plate 40 in a desired location on the cable L during cable installation. The end of the cable L is then forced into the first passageway 26 in the corresponding bracket 16 (see dashed line outline of the end of the cable L and the corresponding action arrow F in FIG. 3*d*). As should be appreciated, the cable L is blindly inserted and passes through the split wedge retainer 28, the halves of which move and separate in unison in the frusto-conical passageway 26 to allow the cable L to pass.

Figure 3D:
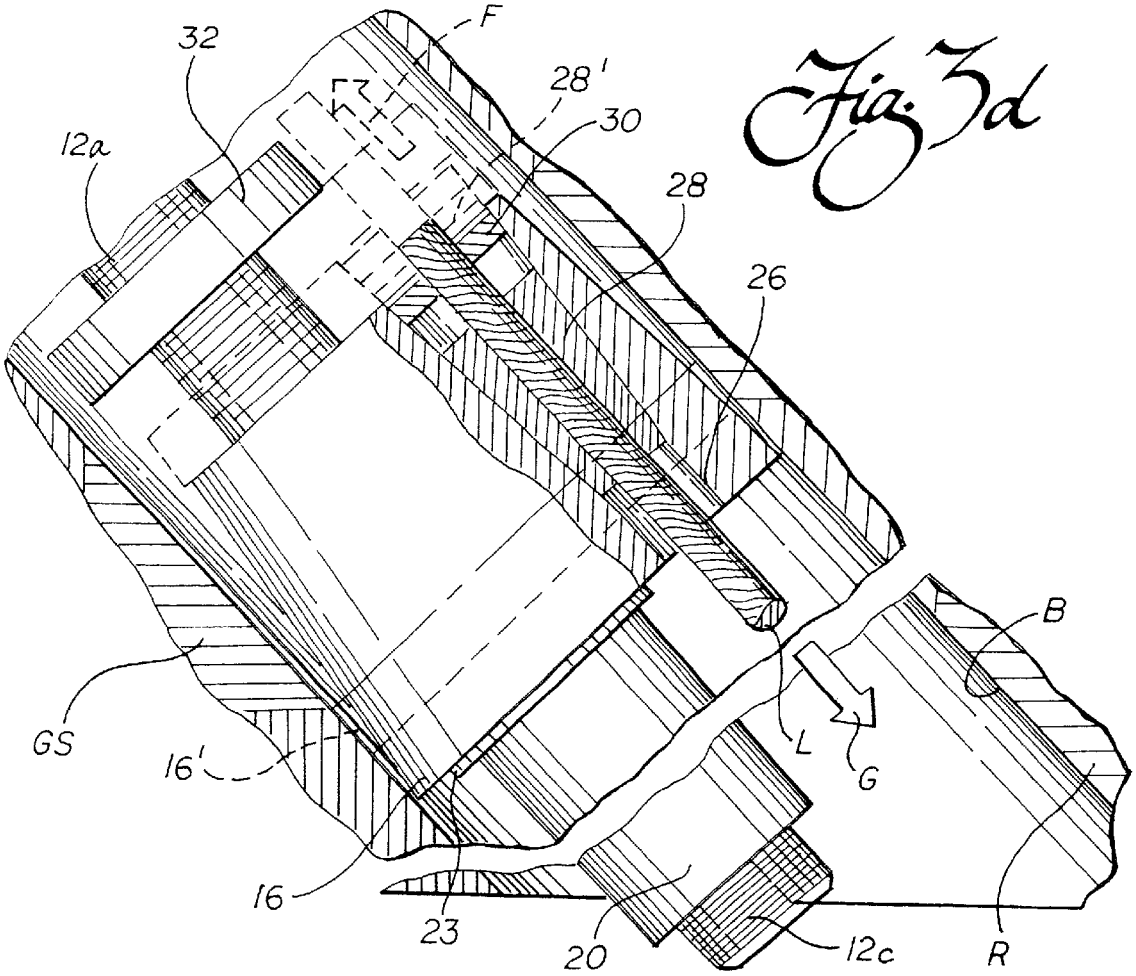
Figure 3C:
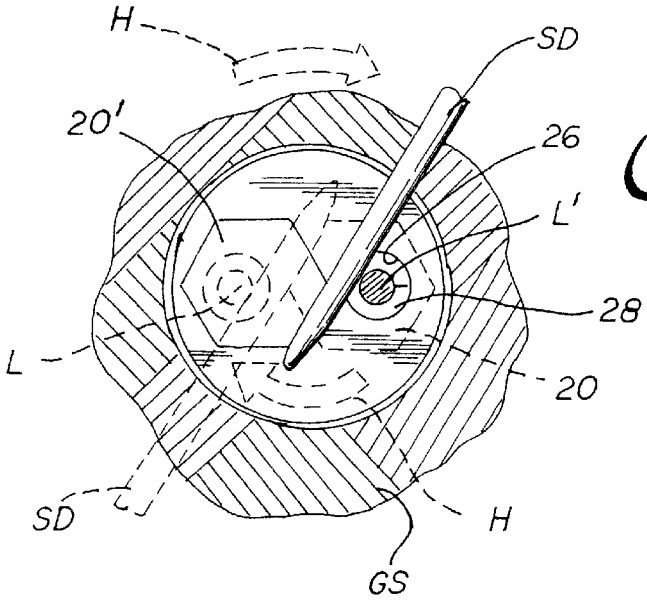

Also, as shown in FIG. 3*d*, both the bracket 16 and split-wedge retainer 28 may lift and move up in the borehole B along the anchor or bolt 12 during this procedure (as shown in phantom and designated by reference numerals 16', 28' in FIG. 3*d*). However, the bracket 16 is prevented from moving any substantial distance along the anchor or bolt 12 by the resilient ring 32, and the split wedge retainer 28 is prevented from completely lifting or backing out of the tapered passageway 26 by the press fit washer 30. Once it passes through the retainer 28 the desired distance (usually about 4–5" for the first borehole), the cable L is manually tugged in the direction of action arrow G in FIG. 3*d*. This in turn snugs the retainer 28 in the frusto-conical passageway 26, such that the cable L is locked in position relative to the bracket 16. Once gripped, the downward force provided by the weight of the cable L and support plate 40 keeps the cable L snugged and securely held in place in the bracket 16.

A similar operation is repeated at the opposite spaced borehole B. A second support plate 42, with corresponding pre-installed stop 44, are adjacent this end of the cable L. The installer blindly passes the end of the cable L through the split wedge retainer 28 in bracket 18, except the length of the cable L passed on this side is usually greater to ensure that substantially all of the cable sag is eliminated, or at least reduced to a minimum to ensure proper tensioning. Of course, if necessary, the installer may also return to the first bracket 16 and push the cable L further into the borehole B to reduce the amount of sag, making sure to again snug the corresponding split wedge retainer 28 in place upon finishing. Once the excess sag is eliminated, if necessary, and the cable L is in place spanning between the brackets 16, 18, the stops 44 may be adjusted to ensure that the support plates 40, 42 remain adjacent to the borehole B. After tensioning, the plates 40, 42 function to support roof R, and to space the cable L from the borehole openings. This prevents long-term damage and deterioration to the cable L, and prevents loss of truss tension.

In accordance with one advantage of the present invention that reduces installation time, it should be appreciated that the relative orientation of the tapered passageways 26 for receiving the respective ends of the cable L does not initially matter during installation. This allows the installer to focus on the work at hand and not concern him or herself with this detail, which is particularly advantageous in high roof conditions. Instead, once the bracket 16 or 18 is positioned and held on the corresponding anchor or bolt 12, 14 and the cable L is inserted in the passageway 26 and snugged in place, a lever, such as the shank of a screwdriver SD or the like, may simply be inserted between the nut 20 and the adjacent cable L in the borehole B. See for example, in FIG. 3*c* where the "bow" nut 20 is shown in dashed line in an initial position and is further shown in solid line and referenced by numeral 20' after being repositioned. The action arrows H show the direction of rotation to move the cable L to the proper position. The cable L must be positioned on the side nearest the adjacent borehole B (note reference character L'). Of course, this action is repeated once the cable L is installed in the opposite bracket, if necessary.

Once the cable L is properly oriented, the sag between the brackets 16, 18 is reduced as much as possible. The installer must then adjust the support plates 40, 42 to ensure proper engagement with the adjacent face, which in the case of the mine roof R involves flipping the plates 40, 42 over from a hanging position. This is shown in FIG. 3*e*, where the support plate 40 is shown in solid line in a hanging position and is further shown in dashed line after being repositioned, as indicated by action arrow J. The substantially planar face of the plate 40' engages the roof R in the operative position.

To tension the cable L, the deep well socket wrench 36 is installed in the rotational socket RS of the bolting machine. The lifting mechanism/pivoting linkage arm PA are together employed to lift and tilt the wrench 36 into engagement with a selected nut 20 or 22, both of which are positioned on the corresponding anchor or bolt 12, 14 adjacent the corresponding borehole B in this most preferred embodiment (see FIG. 3*e*). Once the driving head DH is activated, the wrench 36 tightens the nut 20 and moves the corresponding bracket 16 upward along bolt 12 and further into the borehole B. Since the adjacent portion of the cable L is captured in the bracket 16, and the other end is captured in the opposite bracket 18, this movement serves to create tension in the cable L for supporting the adjacent mine roof R.

Advantageously, since a standard bolting machine includes a torque control feature, such as a hydraulic circuit including a bypass valve or the like, the rotation of the nut 20 is completed when the motor driving the rotational socket RS simply stalls out. As is known in the art, this setting may also be adjusted to ensure that a relatively specific amount of torque is transmitted. The tensioning is thus essentially automatic. Moreover, since the drill head DH is infinitely adjustable and the socket head wrench 36 follows the nut 20 into the borehole B, repositioning the wrench during tensioning is usually unnecessary, which cuts down on installation time and effort. As should also be appreciated, since the sag in the cable L has been reduced to a minimum during installation, the rotation of the selected nut 20 or 22 required to complete final tensioning is minimized.

Once tensioning is completed, the wrench 36 is removed from the corresponding nut 20 and the driving head DH is lowered. This truss system 10 should now be fully installed and tensioned. If necessary for a particular installation, the wrench 36 and driving head DH may be used to further tension the cable L by applying torque to the opposite nut 22 or other fastener, but usually this is unnecessary.

In summary, the results and advantages of the truss system 10 and related installation method of the present invention can now be fully understood and appreciated. The face of a passage, such as a mine roof R, in a geological structure GS can now be secured by the truss system 10 that is installed and fully activated in a highly efficient manner. Advantageously, consistent mine roof compression and uplift can be easily accomplished with the guess work eliminated. The disadvantages of the prior art systems that required an excessive number of components or hand tools for tensioning of the truss members, such as an elongated cable L have now been overcome. Full strength and effectiveness of the truss system 10 of the present invention can thus be accomplished while providing an easier and more productive installation and tension activating method for the installer(s).

The foregoing description of a preferred embodiment of the present invention has been presented for purposes of illustration and description. It is not intended to be exhaustive or to limit the invention to the precise form disclosed. Obvious modifications or variations are possible in light of the above teachings. For instance, while the use of the rotational socket wrench powered by a conventional bolting machine is preferred for the reasons stated above, it is possible to use other arrangements to provide the torque required for tensioning the truss member. Also, while a multi-strand, high strength cable is shown, it should be appreciated that other types of flexible or semi-flexible truss members may be used, the only requirement being that the selected truss member is capable of bending and being tension-activated. The present embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A truss and installation system for supporting a face of a passage in a geological structure, comprising:

first and second anchors, each positioned in a borehole formed in the face of the geological structure;

first and second brackets, each carried on one of said first and second anchors;

first and second fasteners, each for holding one of said brackets on the corresponding anchor;

at least one truss member spanning between said brackets; and a motive device for engaging and moving at least one of said fasteners along the corresponding anchor to move the corresponding bracket at least partially into the borehole to tension said truss member.

2. The truss and installation system according to claim 1, wherein each said fastener is a rotary fastener threaded to a proximal end of the corresponding anchor.

3. The truss and installation system according to claim 2, wherein said motive device is a rotational socket, whereby upon rotating a corresponding one of said first and second fasteners, the corresponding bracket is drawn along the associated anchor and the at least one truss member is tensioned.

4. The truss and installation system according to claim 3, further including a bolting machine to support and provide power for said rotational socket.

5. The truss and installation system according to claim 1, wherein at least one of said brackets is substantially cylindrical to facilitate entry into the corresponding borehole during tensioning.

6. The truss and installation system according to claim 1, wherein said first and second anchors each include a proximal segment and a distal segment joined together by a coupler.

7. The truss and installation system according to claim 1, wherein said at least one truss member is a cable, and each said bracket carries a retainer for receiving and securely holding said cable during tensioning.

8. The truss and installation system according to claim 7, wherein at least one of said retainers is a split wedge retainer carried in a frusto-conical passageway in at least one of said brackets, whereby said split wedge retainer allows an end of said cable to blindly pass into the corresponding borehole, yet tightly grips said cable when snugged.

9. The truss and installation system according to claim 8, wherein a stop is positioned in said frusto-conical passageway to prevent said split-wedge retainer from backing out during the insertion of the cable.

10. The truss and installation system according to claim 1, further including at least one support carried on said truss member for engaging the face of the passage in the geological structure when said truss member is tensioned.

11. The truss and installation system according to claim 10, wherein said at least one support is held in position during tensioning by at least one stop carried on said truss member.

12. The truss and installation system according to claim 1, further including a pair of supports carried on said truss member, each said support engaging the face of the passage when said truss member is tensioned.

13. A truss system including at least one truss member spanning between first and second anchors, each secured in a spaced borehole formed in the face of a geological structure, comprising:

first and second brackets, each said bracket having a first passageway for receiving one of the anchors and a second passageway carrying a retainer for receiving and capturing an end of the at least one truss member;

first and second rotary fasteners, each for holding one of said brackets on the corresponding anchor;

whereby a selected one of said fasteners is rotated and moved along said anchor such that the corresponding bracket is drawn at least partially into the borehole to tension the truss member.

14. The truss system according to claim 13, wherein each said bracket is substantially cylindrical to facilitate entry into the corresponding borehole.

15. The truss system according to claim 13, wherein said truss member is a cable.

16. The truss system according to claim 13, further including a driving head having a rotational socket on a bolting machine for selectively rotating said rotary fasteners.

17. A truss support bracket for use in a truss system including at least one truss member spanning between first and second anchors, at least one of which extends into a borehole formed in the face of a geological structure, said truss support bracket comprising:

a body adapted for insertion in the borehole, said body having a first passageway for receiving an end of one of the anchors and a second, substantially parallel frusto-conical passageway;

a split wedge retainer carried in said second passageway for receiving and capturing a first end of the least one truss member;

whereby upon drawing said body along said anchor and at least partially into the borehole, said at least one truss member is tensioned to compress and provide support for the adjacent face.

18. The truss support bracket according to claim 17, wherein said body is substantially cylindrical.

19. A method for supporting a face of a passage in a geological structure, comprising:

drilling first and second spaced boreholes in the face;

installing an anchor in each said borehole;

positioning a truss support bracket on each said anchor;

spanning at least one truss member between each of said support brackets; and selectively moving at least one of said brackets along the anchor into the corresponding borehole to tension said at least one truss member.

20. The method according to claim 19, wherein drilling a selected one of the first and second spaced boreholes includes drilling a first bore having a first diameter and a second bore having a second diameter, wherein said first bore is oversized to allow said bracket to move into said selected borehole.

21. The method according to claim 19, wherein installing said first and second anchors includes placing a resin cartridge in each said borehole and using a distal end of each said anchor to rupture said resin cartridge, whereby upon rupturing, the resin in said cartridge mixes with a catalyst and cures to hold the corresponding anchor securely in place.

22. The method according to claim 19, wherein a proximal end of each anchor is threaded, and said method further includes securing the bracket on each of said anchors by placing a corresponding threaded fastener on each said proximal end.

23. The method according to claim 19, further including placing at least one support for engaging the face on the truss member prior to spanning the truss member between the brackets.

24. The method according to claim 19, wherein spanning said at least one truss member includes attaching a first and second end of the truss member in a retainer carried by each of said brackets.

25. The method according to claim 24, wherein each said retainer is a split wedge retainer, and said attaching step includes blindly passing the first and second ends of the truss member through an opening in the corresponding split wedge retainer and then snugging the retainer to capture and hold the truss member therein.

26. The method according to claim 24, wherein after attaching the end of the truss member in the retainer in the corresponding bracket, the bracket is rotated in the borehole such that the truss member is nearest to the opposite borehole.

27. The method according to claim 19, wherein selectively moving one or both of the brackets along the anchors is completed by engaging a fastener threaded on a proximal end of the respective anchor with a wrench powered by a driving head on a bolting machine.

* * * * *